US006029885A

United States Patent [19]

Mueller

[11] Patent Number: 6,029,885

[45] Date of Patent: Feb. 29, 2000

[54] RAPID ASSEMBLY BOX

[76] Inventor: Charles J. Mueller, 140 W. Kohler, Sun Prairie, Wis. 53590

[21] Appl. No.: 09/294,603

[22] Filed: Apr. 19, 1999

Related U.S. Application Data

[63] Continuation-in-part of application No. 09/141,454, Aug. 27, 1998, Pat. No. 5,967,407.

[51] Int. Cl.[7] ..... B65D 5/22

[52] U.S. Cl. ..... 229/125.19; 229/176; 229/178; 229/182

[58] Field of Search ..... 229/125.19, 145, 229/152, 154, 176, 178, 182

[56] References Cited

U.S. PATENT DOCUMENTS

| | | | |
|---|---|---|---|
| 906,138 | 12/1908 | Hougland | 229/177 |
| 1,886,879 | 11/1932 | Gross | 229/178 |
| 2,100,750 | 11/1937 | Ringler | 229/178 |
| 2,214,813 | 9/1940 | Guyer | 229/182 |
| 2,217,503 | 10/1940 | Bergstein | 229/176 |
| 2,220,076 | 11/1940 | Carruth | 229/182 |
| 2,233,874 | 3/1941 | Rosenthal | 229/182 |
| 2,591,500 | 4/1952 | Bloomer | 229/178 |
| 2,707,587 | 5/1955 | Wittstein | 229/178 |
| 2,774,530 | 12/1956 | Bolding et al. | 229/176 |
| 2,963,210 | 12/1960 | Gillmore | 229/178 |
| 3,102,674 | 9/1963 | Hamilton | 229/178 |
| 3,162,350 | 12/1964 | Miller | 229/178 |
| 3,258,191 | 6/1966 | Mueller et al. | 229/182 |
| 3,275,215 | 9/1966 | Paige | 229/178 |
| 3,887,126 | 6/1975 | Wilson | 229/176 |
| 4,214,694 | 7/1980 | Struble | 229/176 |
| 4,306,658 | 12/1981 | Montealegre | 229/154 |
| 4,441,451 | 4/1984 | Neal | 229/178 |
| 4,632,301 | 12/1986 | Slack | 229/145 |
| 4,765,535 | 8/1988 | Michetti | 229/172 |
| 4,911,355 | 3/1990 | Bannister | 229/178 |
| 5,249,550 | 10/1993 | Hines et al. | 229/178 |
| 5,429,296 | 7/1995 | Southwell et al. | 229/178 |
| 5,494,214 | 2/1996 | Fleury et al. | 229/178 |
| 5,535,942 | 7/1996 | Vilona | 229/178 |
| 5,544,806 | 8/1996 | Anderson et al. | 229/178 |
| 5,967,407 | 10/1999 | Mueller | 229/125.19 |

OTHER PUBLICATIONS

Photograph of box lid submitted in IDS by Applicant as paper #3.

Menasha Corporation—Die cut diagram of infolded tray—Sep. 2, 1997.

Photograph of Kimberly–Clark Corporation box blank.

*Primary Examiner*—Gary E. Elkins

*Attorney, Agent, or Firm*—Lathrop & Clark LLP

[57] ABSTRACT

A container blank has a bottom panel with outwardly extending inner and outer end panels which fold up to form double thickness end walls. Two opposed parallel side panels have glue tabs which are affixed to the outer end panels. Each glue tab has a 45-degree angle fold line which allows the side panels to be folded to overlie the bottom panel during shipping. In a covered box where the height of the box h measured vertically exceeds one quarter the length of the end panel and approaches one half the length of the end panels, there is not space available to receive the cover front flap tab within a pocket defined between the end wall and an adhesively attached glue tab, if the glue tabs in front and in back are of equal size. To accommodate the enlarged cover front flap tabs, the front glue tabs may extend a greater distance along the end panels than the rear glue tabs. The rear glue tabs are less than half the length of the outer end panels, and do not extend frontwardly beyond the glue tab fold line. The glue attachment region on the rear glue tabs may thus be located only on the triangular region defined below the glue tab fold line.

10 Claims, 8 Drawing Sheets

RAPID ASSEMBLY BOX

CROSS REFERENCES TO RELATED APPLICATIONS

This application is a continuation-in-part of application Ser. No. 09/141,454, filed Aug. 27, 1998, now U.S. Pat. No. 5,967,407, the disclosure of which is incorporated by reference herein.

STATEMENT AS TO RIGHTS TO INVENTIONS MADE UNDER FEDERALLY SPONSORED RESEARCH AND DEVELOPMENT

BACKGROUND OF THE INVENTION

The present invention relates to boxes which are expandable from a flattened configuration.

Many goods, be they intended for consumer or producer use, require protection and shielding as they are shipped or stored. The temporary containers in which the products are transported must be sufficiently strong to adequately protect the contents, while at the same time not add inordinately to the cost of the product. Corrugated paperboard containers have won widespread acceptance not only for short term shipment and storage, but also for long term warehousing of documents and records.

Corrugated paperboard containers are formed from sheet stock and are usually glued into flattened assemblies for shipment to the end user. The boxes are typically erected by a sequence of folding and bending steps. In fully automated operations, where many identical boxes are assembled in a fixed location, machines are available which present assembled boxes for filling. In more specialized situations however, where boxes of many different sizes are required, or where the location of box usage is variable, boxes are still commonly assembled by hand. In hand assembly ease of box assembly is of key concern to reduce time of assembly as well as the fatigue of the assemblers.

Storage boxes with automatic erecting bottoms are known, such as my High Stacking Strength Automatic Corrugated Box, disclosed in my U.S. Pat. No. 5,887,782, the disclosure of which is hereby incorporated by reference. Other corrugated containers are known in which two adjacent side walls are connected to one another by glue tabs having angled folds, such as my earlier U.S. Pat. No. 3,258,191 or U.S. Pat. No. 2,220,076 to Carruth.

What is needed is a container which is readily erected from a glued-up corrugated paperboard blank which is assembled with a minimum of steps, and which is economical to produce.

SUMMARY OF THE INVENTION

The container of this invention is readily set up by hand from a glued-up blank. The blank has a bottom panel with outwardly extending inner and outer end panels which fold up to form double thickness end walls. Two opposed parallel side panels have glue tabs which are affixed to the outer end panels. Each glue tab has a 45-degree angle fold line which allows the side panels to be folded to overlie the bottom panel during shipping. By pivoting the outer end panels to be perpendicular to the bottom panel, the side panels are brought upright by the attached glue tabs, and the inner end panels are thus prepositioned to be engaged over the glue tabs. The structure may be incorporated within a covered box. As the vertical depth of the box is selected to be a greater dimension, the material available to define the cover front flap tabs also increases. Where the height of the box h measured vertically exceeds one quarter the length of the end panel and approaches one half the length of the end panels, there no longer is space available to receive the cover front flap tab within a pocket defined between the end wall and an adhesively attached glue tab, if the glue tabs in front and in back are of equal size. To accommodate the enlarged cover front flap tabs, the front glue tabs may extend a greater distance along the end panels than the rear glue tabs. The longer front glue tabs are adhesively connected to the outer end panels by a rectangular glue attachment region which is positioned rearwardly of the pockets which will be occupied by the front glue tabs. The rear glue tabs are less than half the length of the outer end panels, and may not extend frontwardly beyond the glue tab fold line. The glue attachment region on the rear glue tabs may thus be located only on the triangular region defined below the glue tab fold line.

It is another object of the present invention to provide a covered container which may be easily and rapidly assembled by hand.

It is a further object of the present invention to provide a container with at least two double thickness walls which is easily assembled in a low fatigue manner.

It is an additional object of the present invention to provide a container with laminated double thickness end walls.

Further objects, features and advantages of the invention will be apparent from the following detailed description when taken in conjunction with the accompanying drawings.

DESCRIPTION OF THE PREFERRED EMBODIMENTS

Figure 1:
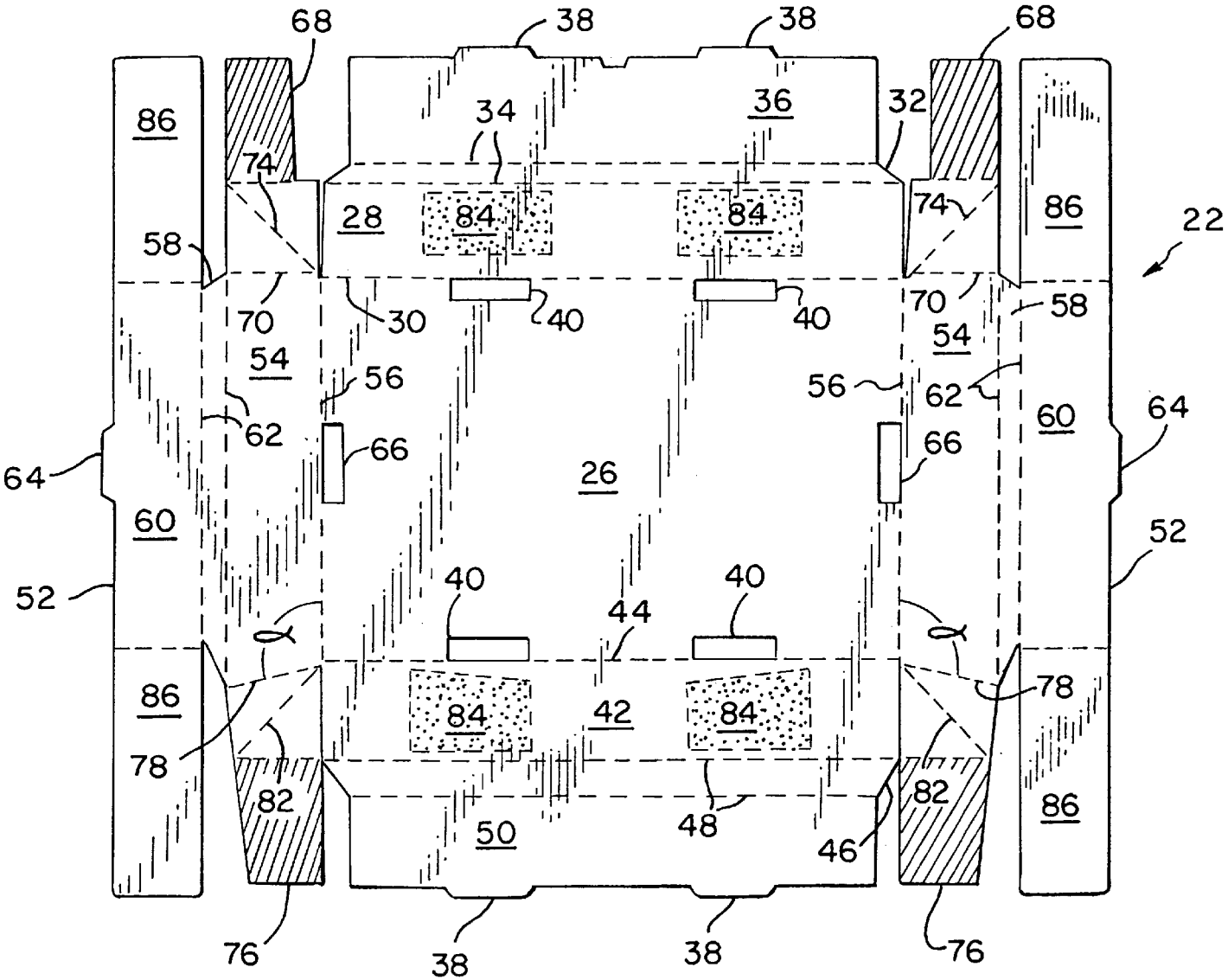
FIG. 1 is a top plan view of a blank for assembly into a display box of this invention.
Figure 2:
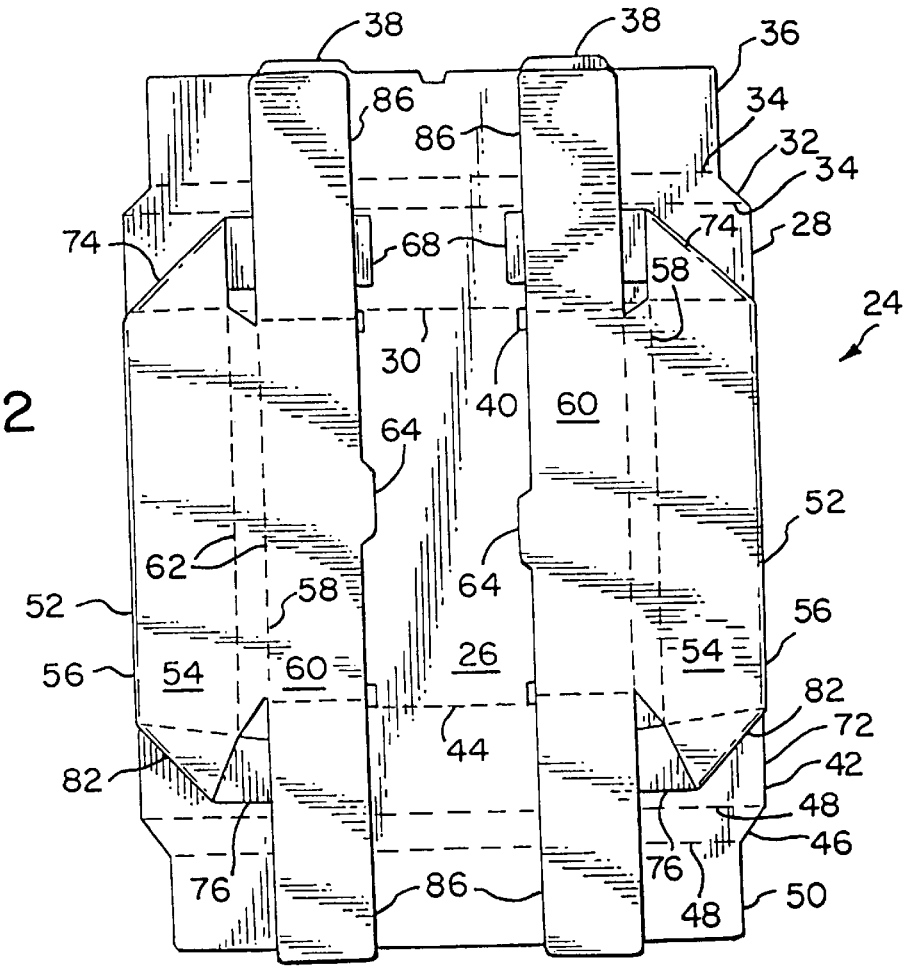
FIG. 2 is a plan view of a glued up and knocked down blank of FIG. 1.
Figure 3:
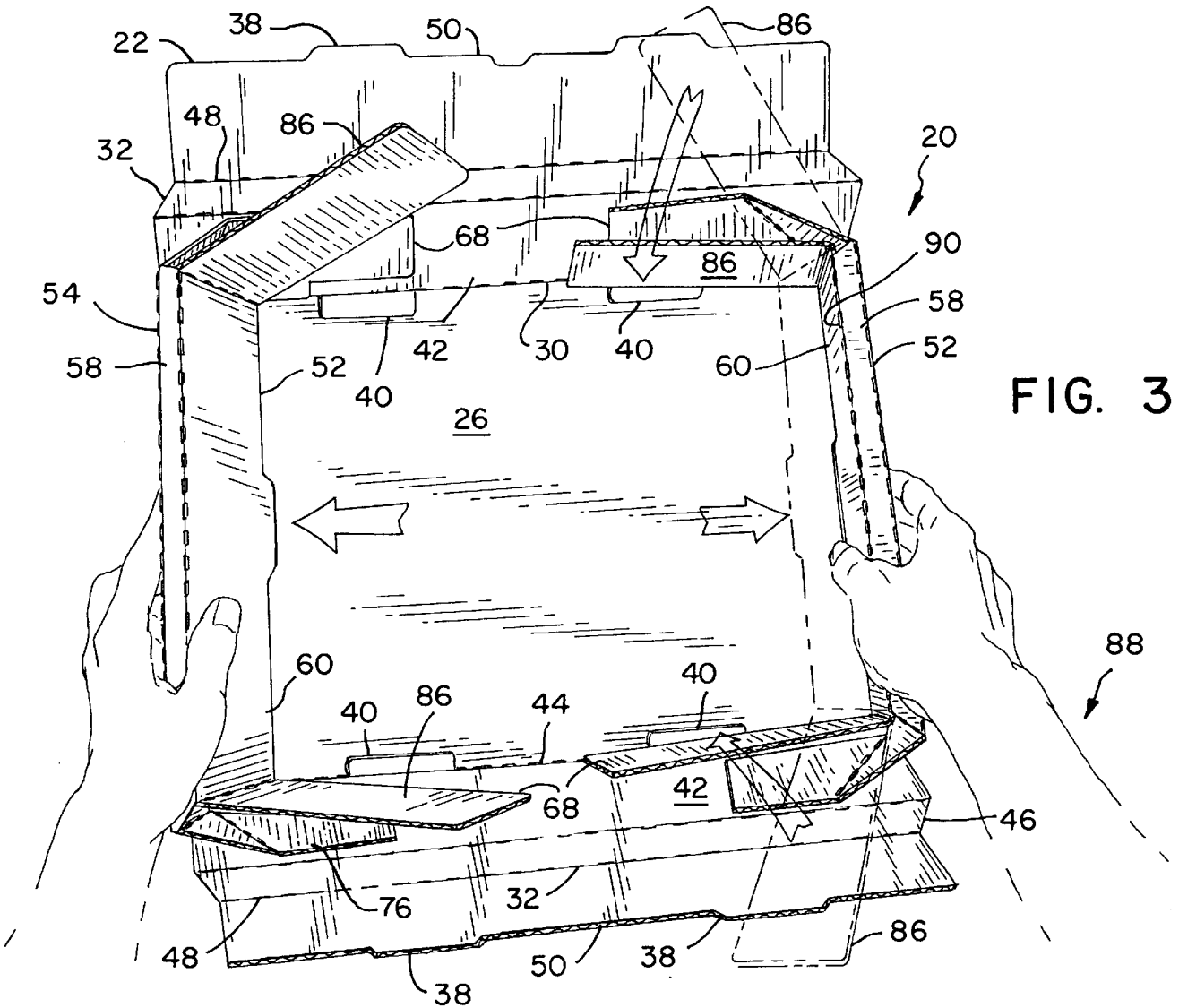
FIG. 3 is a perspective view of the article of FIG. 2 being assembled into a display box.

Referring more particularly to FIGS. 1–12, wherein like numbers refer to similar parts, a display box or shadow box 20 of this invention is shown in FIGS. 1–3. The box 20 is assembled from a single corrugated paperboard blank 22, shown in FIG. 1. The blank 22 is glued up in the manufacturing process to form the knocked-down box 24, shown in FIG. 2, which is readily assembled in a two step assembly process into the shadow box 20 which has double thickness walls and which is inclined to display the contents for retail viewing.

As shown in FIG. 1, the blank 22 has a generally rectangular rear panel 26 from which an outer top panel 28 extends along a fold line 30. The outer top panel 28 defines the exterior top surface of the assembled box 20. A narrow framing front panel 32 is connected along two parallel fold lines 34 between the outer top panel 28 and an inner top panel 36. The inner top panel 36 defines the inside top wall of the assembled shadow box 20. Two lock tabs 38 protrude from the inner top panel. In the assembled box 20, the lock tabs 38 are received within narrow rectangular cut-outs 40 positioned on the rear panel adjacent the outer top panel 28. When assembled, the inner top panel 36 and the outer top panel 28 will be positioned parallel to one another and will define a double wall in the shadow box.

Another double wall is formed in the shadow box 20 by panels which extend from the rectangular rear panel 26 beneath the inner and outer top panels. An outer bottom panel 42 extends along a fold line 44. The outer bottom panel 42 defines the exterior bottom surface of the assembled box 20. A narrow framing front panel 46 is connected along two parallel fold lines 48 between the outer bottom panel 42 and an inner bottom panel 50. The inner bottom panel 50 defines the inside bottom wall of the assembled shadow box 20. Two lock tabs 38 protrude from the inner bottom panel. In the assembled box 20, the lock tabs 38 are received within narrow rectangular cut-outs 40 positioned on the rear panel adjacent the outer bottom panel 42. When assembled, the inner bottom panel 50 and the outer bottom panel 42 will be positioned parallel to one another and will define a double wall in the shadow box.

The sides of the box 20 are formed by two panel-and-tab assemblies 52 which extend sidewardly from the rear panel 26. Each assembly 52 has an outer side panel 54 which extends from the rear panel 26 along a fold line 56 which is perpendicular to the fold lines 30, 44. A narrow side front panel 58 connects the outer side panel 54 to an inner side panel 60 along two parallel fold lines 62. A lock tab 64 extends from the inner side panel 60 and is positioned to extend into a rectangular cut-out 66 on the rear panel adjacent the outer side panel 54. When assembled, each inner side panel is parallel to an outer side panel to from a double thickness side wall. The angular relationships between the side panels and the top and bottom panels are maintained by two pairs of tabs in each assembly 52.

A top glue tab 68 extends from each outer side panel 54 along a fold line 70, and is approximately the same height as the outer side panel. The fold line 70 extends perpendicular to the fold line 56, and the top glue tab 68 is glued to the outer top panel 28 such that the assembled outer top panel and outer side panel will be perpendicular to one another. To permit the glued-up box 72 to be shipped in a generally flat configuration, as shown in FIG. 2, the top glue tab 68 must be provided with an angled fold line 74, which is at 45 degrees from the top glue tab fold line 70.

A bottom glue tab 76 extends from the outer side panel 54 along a fold line 78 which may be perpendicular to the fold line 56, but in a display shadow box 20, in which it is desired to have the box tipped rearwardly, the fold line 78 is preferably at an angle $\alpha$ which is greater than 90 degrees with respect to the fold line 56. The bottom glue tab 76 is divided by a glue tab fold line 82. The angle of the glue tab fold line 82 with respect to the fold line 78 is determined by the relationship:

$$\frac{180 - \alpha}{2}$$

Hence this angle will be 45 degrees when the angle $\alpha$ is 90 degrees, and will be less than 45 degrees when $\alpha$ is greater than 90 degrees.

Portions of the top glue tabs 68 and the bottom glue tabs 76 are connected with an adhesive to the glue regions 84 of the inside surfaces of the outer top panel and the outer bottom panel respectively. The portions of the glue tabs 68, 76 which will be adhered to the glue regions 84 but which are positioned on the underside of the blank as shown in FIG. 1 are show with parallel shading lines in FIG. 1. Similar markings are used in the remaining figures to indicate glue attachment regions which are not directly visible in a particular view. Because the glue tabs extend beyond the glue tab fold lines, greater surface area for adhesive connection is provided, making it possible to have an adhered surface area of each glue tab which is greater than the nonadhered surface area.

Side tabs 86 extend from each of the inner side panels 60. The side tabs 86 are approximately the same height as the inner side panels, and, in the assembled box 20, extend between the inner and outer top panels, and between the inner and outer bottom panels. The side tabs 86 are prevented from escaping from between the side top and bottom walls by the top front panel and the bottom front panel.

As shown in FIG. 2, the glued-up box 72 is folded for shipment with the side panels and associated tabs overlying the top panels and the bottom panels, and is only two thicknesses or three thicknesses of corrugated paperboard at any point.

The shadow box 20 is assembled with great ease manually because of the adhesive connection between the side panels and the top and bottom panels. Such a box is commonly used for packaging cheeses and other variable sized objects for retail display. Because the contents of each box may vary, or boxes of the same size may be assembled in small batches, these boxes are commonly assembled by hand. Because of the need to position the side tabs between the inner and outer panels at the top and bottom of the box, prior art shadow boxes without any connection between the side and top and bottom panels can be difficult or cumbersome to assemble. The shadow box 20 of this invention, as shown in FIG. 3, is readily assembled in a two step process. First the assembler 88 places one hand on each side panel and tab assembly 52 so that the thumb extends over the inner side panel and the fingers overlie the outer side panel. By closing the hand and bringing the thumb closer to the fingers, the lock tabs on the inner side panels are brought into engagement with the rear panel cutouts and the inner panels are brought parallel to the outer panels. Moreover, because the glue tabs are affixed to the outer top panel and the outer bottom panel, the step of erecting the side panels also causes the outer top panel and the outer bottom panel to rise up to a position approximating their final position. At the same time, this closing of the assembler's hands simultaneously brings the side tabs 86 down to extend parallel to the outer top panel and the outer bottom panel. The glue tab connections thereby causes the side tabs to be automatically prepositioned for the final assembly step. All that remains to complete assembly of the box 20 is to fold the inner top panel over the side tabs 86 and bring the inner top panel lock tabs into engagement with the cut-outs on the rear panel, and to perform a similar operation on the inner bottom panel.

In the assembled box 20, the front panels 32, 46, 58, which preferably have miter-cut edges, form a framing front surface which encircles the storage cavity 90 of the box. Typically the boxes 20 may be shipped with the rear panel positioned horizontally, for later display with the rear panel positioned upright and tilted rearwardly.

Figure 4:
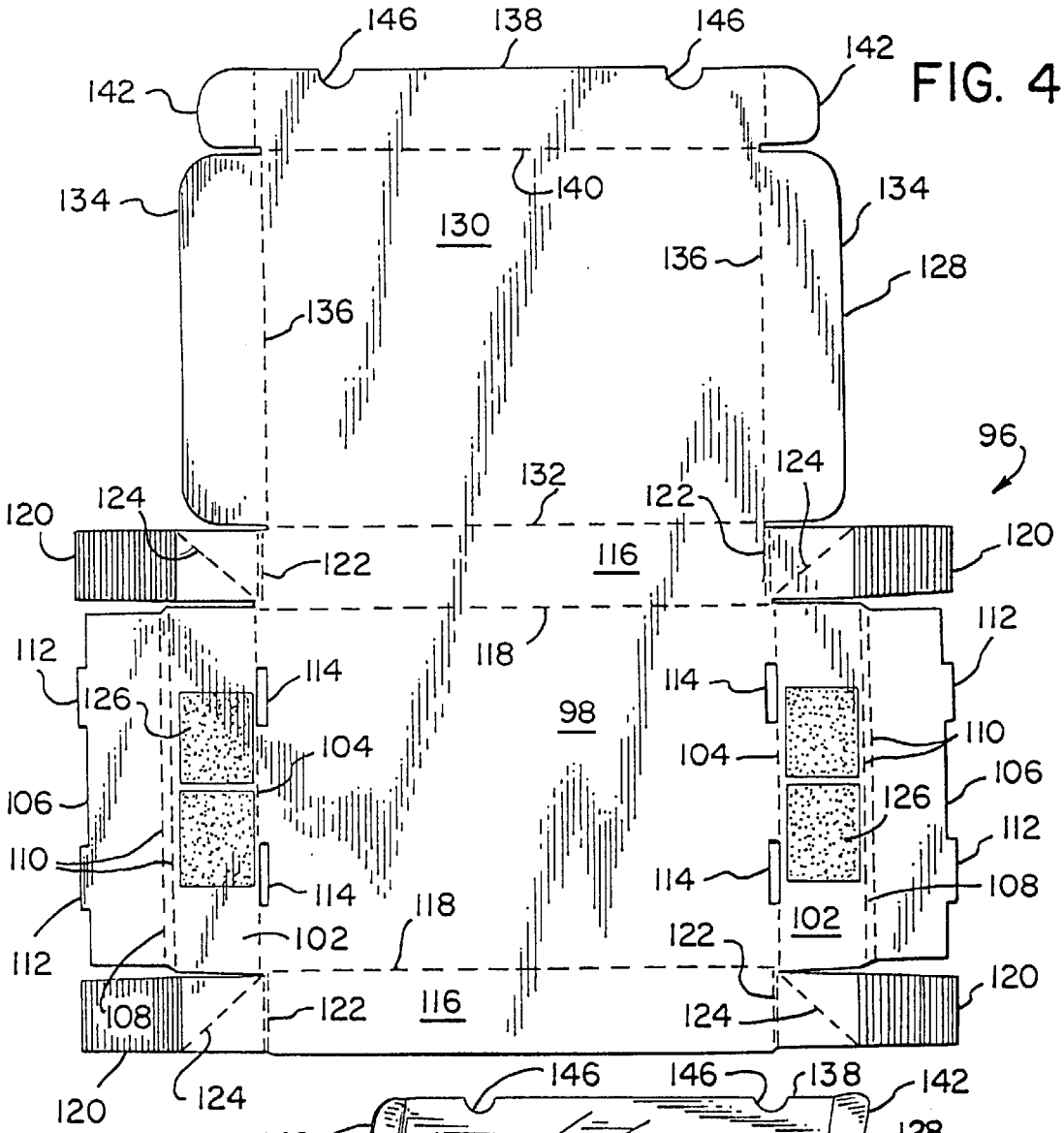
FIG. 4 is a top plan view of a blank for assembly into a lidded box of this invention.
Figure 5:
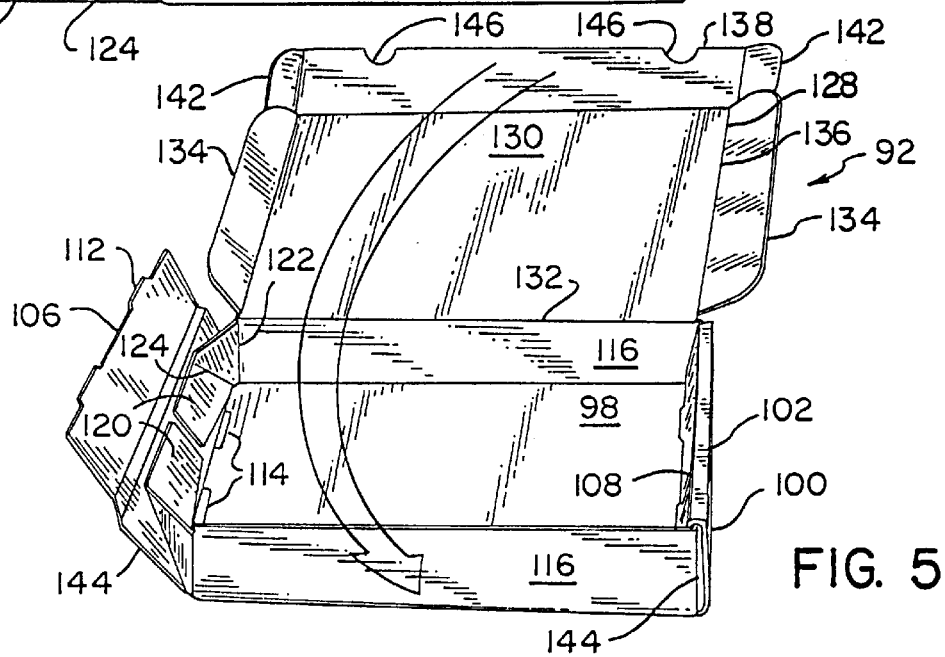
FIG. 5 is a perspective view of the partially assembled box of FIG. 4.

A rapid assembly box 92 of this invention which has a lid or cover 128, is shown in FIGS. 4 and 5. The box 92 is formed from a corrugated paperboard blank 96 which has a rectangular bottom panel 98. Double thickness end walls 100 are formed on opposite sides of the bottom panel 98. Each end wall 100 is made up of an outer end panel 102 which extends from a fold line 104 adjacent the bottom panel, and an inner end panel 106 which is connected to the outer end panel by a narrow rectangular spacer panel 108. The inner end panel 106 and the outer end panel 102 extend from the spacer panel 108 along two parallel fold lines 110. Each inner end panel 106 has two protruding lock tabs 112 which are positioned to engage within rectangular cut-outs 114 formed in the bottom panel adjacent the outer end panel 102.

Two side panels 116 extend from the bottom panel 98 along parallel fold lines 118 which are spaced on either side of the end panels. Each side panel 116 has two glue tabs 120. As shown in FIG. 5, each glue tab 120 extends from a side panel 116 along a fold line 122 which is perpendicular to the fold line 118. A glue tab fold line 124 extends from the fold line 122 at a 45 degree angle, and divides the glue tab 120 to permit the box to be shipped in a glued up but knocked down condition. Each glue tab 120 is connected to an outer end panel 102 by an adhesive applied to a region of the glue tab 120 outward of the glue tab fold line 124. The regions of adhesive attachment on the outer end panels 102 are indicated by the shaded regions 126 in FIG. 4. The glue regions 126 are approximately rectangular and terminate at an inner edge which is generally parallel to the fold lines 120. In other words, the adhered regions of the glue tab are all located a distance away from the fold line 122 a distance greater than the furthest extent of the glue tab fold line 124. Because of the positioning of the glue regions, there is no need to apply glue in a triangular pattern, facilitating manufacture of the container. The length of a glue tab 120 is preferably sufficient that it extends approximately to the center of an inner end panel 106 when it is glued thereto. The extended length of the glue tabs 120, when glued to the end panels, gives increased top-to-bottom and end-to-end compressive strength, as well as reduced racking or longitudinal twist of the container. Furthermore, because the glue tabs in the cut blank extend along the inner and outer end walls, it may be observed that the full length of the glue tabs will not exceed the combined heights of the inner and outer end panels so long as the width of the box is less than four times the depth of the box. This is so because the length of the glue tab z is ½ the width of the box y, and the length of the glue tab z may be slightly greater than twice the height x of both the inner end panel and the outer end panel. Therefore, the glue tabs will not result in additional blank waste so long as $2(2x)<y$.

A cover 128 extends from one of the side panels 116. The cover 128 has a cover panel 130 which extends from a side panel 116 along a fold line 132. The cover panel 130 has two opposed side flaps 134 which extend from fold lines 136, and a front flap 138 which extends from the cover panel along a fold line 140 which is parallel to the fold line 132. The cover front flap has two generally semicircular tabs 142 which extend outwardly. In the assembled box 92, the cover front flap tabs 142 are received within pockets 144 defined between the outer end panels 102 and the glue tabs 120 at regions where the glue tabs are not glued to the outer end panels.

To erect the box 92, the assembler grips the sides of the ends of the box, with fingers beneath the outer end panels 102, and thumbs beneath the inner end panels 106. While pressing upward to rotate the outer end panels 102, the thumbs are brought down to pivot the inner end panels 106 about their fold lines 110 and to engage the lock tabs 112 in the bottom panel cut-outs 114, thereby engaging the glue tabs 120 between the outer end panels and the inner end panels. The box 92 is now assembled and ready to be filled. Once the contents have been placed within the box 92, the cover 128 may be closed on the box to bring the cover side flaps 134 alongside the inner end panels 106, and to position the cover front flap 138 alongside an outer side panel, such that the cover front flap tabs 142 are received within the pockets 144. To facilitate opening of the box 92, two semicircular finger openings 146 may be cut in the cover front flap 138.

In the glued-up but knocked-down configuration, the end panels 102,106 lie in the same plane as the bottom panel 98, the side panels 116 overlie the bottom panel, and the cover panel 130 overlies the bottom panel and one of the side panels.

Figure 8:
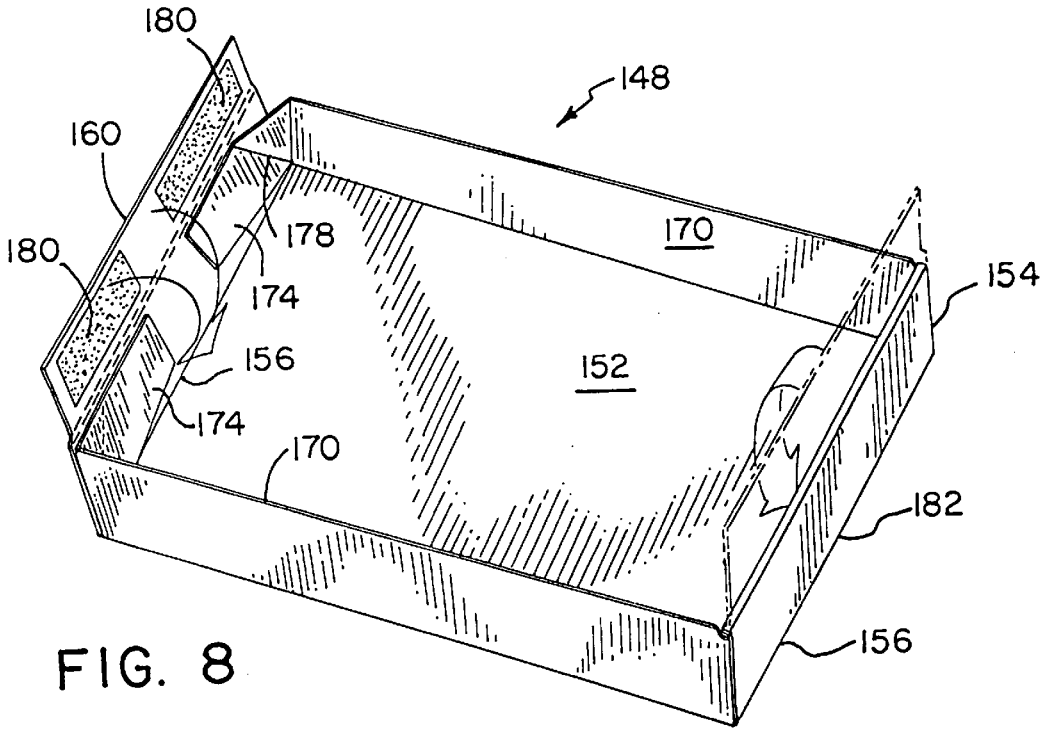
FIG. 8 is a perspective view of the assembled tray of FIG. 7.
Figure 6:
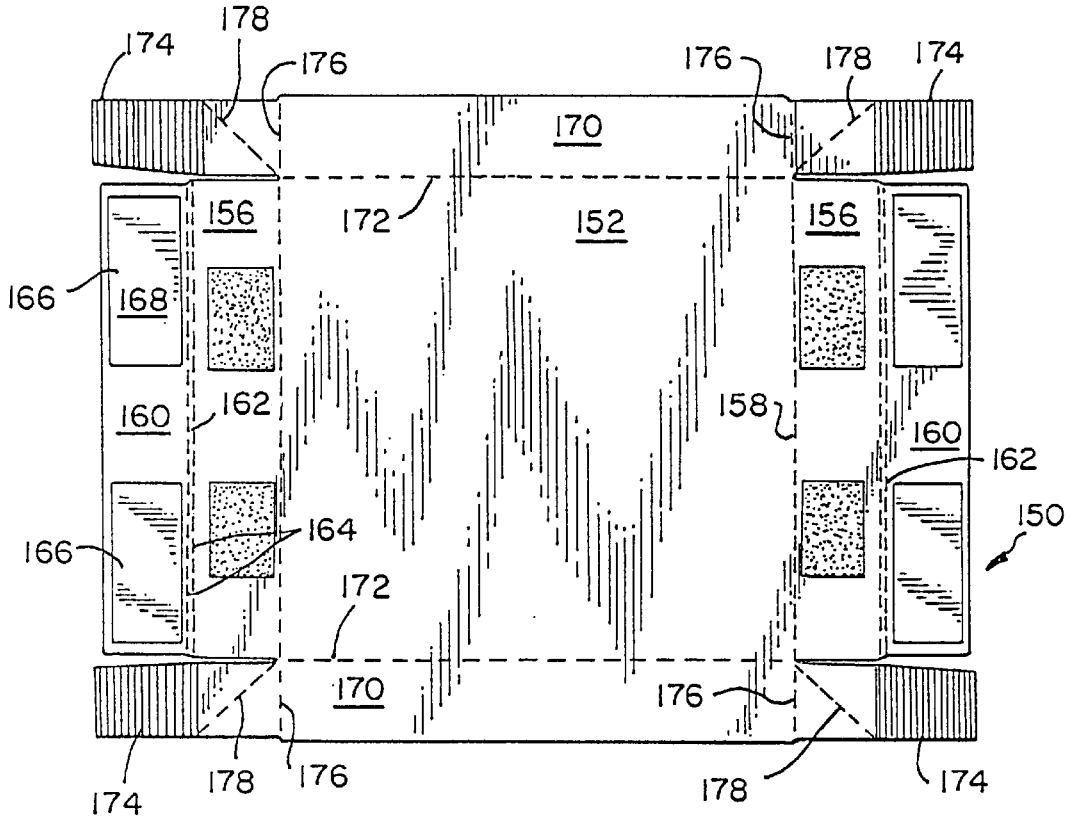
FIG. 6 is a top plan view of a blank for assembly into a tray of this invention.
Figure 7:
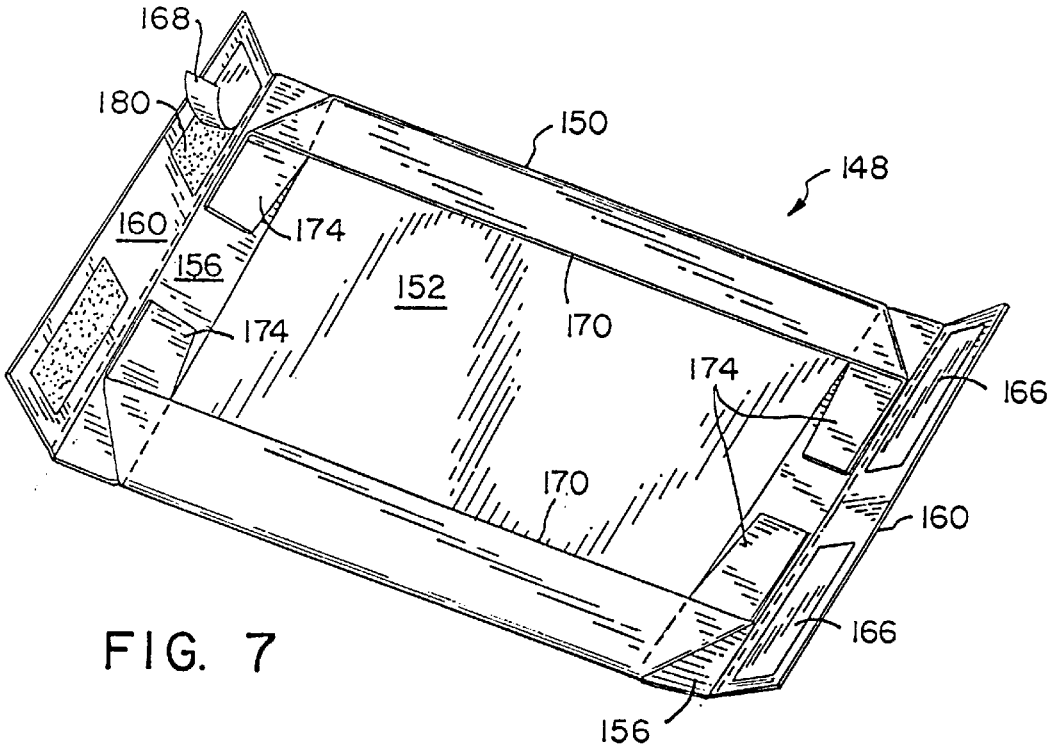
FIG. 7 is a perspective view of the glued up and knocked down blank of FIG. 6.

Another assembly of this invention is shown in FIGS. 6–8. The assembly 148 may be used as a shallow open box, as a tray, or as a lid. The assembly 148 is similar to the box 92, but employs double-sided pressure-sensitive adhesive tape to eliminate the need for lock tabs and cut-outs. The assembly 148 is formed from a blank 150 which has a rectangular bottom panel 152. Double thickness end walls 154 are formed on opposite sides of the bottom panel. Each end wall 154 is made up of an outer end panel 156 which extends from the bottom panel 152 along a fold line 158 and an inner end panel 160 which is connected to the outer end panel by a spacer panel 162 which extends along two fold lines 164. One or more strips 166 of pressure sensitive adhesive is positioned to extend along each inner end panel. The adhesive strips 166 are covered by a peel-away release liner 168. The adhesive and release liner are preferably applied as a single assembly, for example 476-XL tape manufactured by Minnesota Mining and Manufacturing Co. of Minneapolis, Minn.

Two side panels 170 extend from the bottom panel along parallel fold lines 172 positioned on either side of the end panels. Each side panel 170 has two glue tabs 174, of approximately the same height as the side panels. Each glue tab 174 extends from a side panel 170 along a fold line 176 which is perpendicular to the fold line 172. A glue tab fold line 178 extends at a 45-degree angle from the corner of the side panel 170. The glue tabs 174 of the two side panels 170 are glued to the end panels with an adhesive positioned in a glue region 180. The assembly 148 is shipped in a flat configuration, with the side panels overlying the bottom panel 152. To erect the assembly 148, the assembler peels the release liners 168 away to uncover the pressure sensitive adhesive, as shown in FIG. 7, and then pivots the inner end panels 160 to overlie the outer end panels 156 and presses the two adjacent panels together to form a double thickness end wall laminate 182. As with the other embodiments discussed above, the connection between the glue tabs and the side walls causes the side panels to be automatically erected into a condition extending upright from the bottom wall when the end panels are brought into an upright condition. The assembly 148 advantageously eliminates the need for any cut-outs or apertures in the bottom wall, making it appropriate for use as a tray or as a protective lid or cover for another container, for example as a cover for the High Stacking Strength Automatic Corrugated Box disclosed in my copending U.S. patent application Ser. No. 08/936,329.

Figure 9:
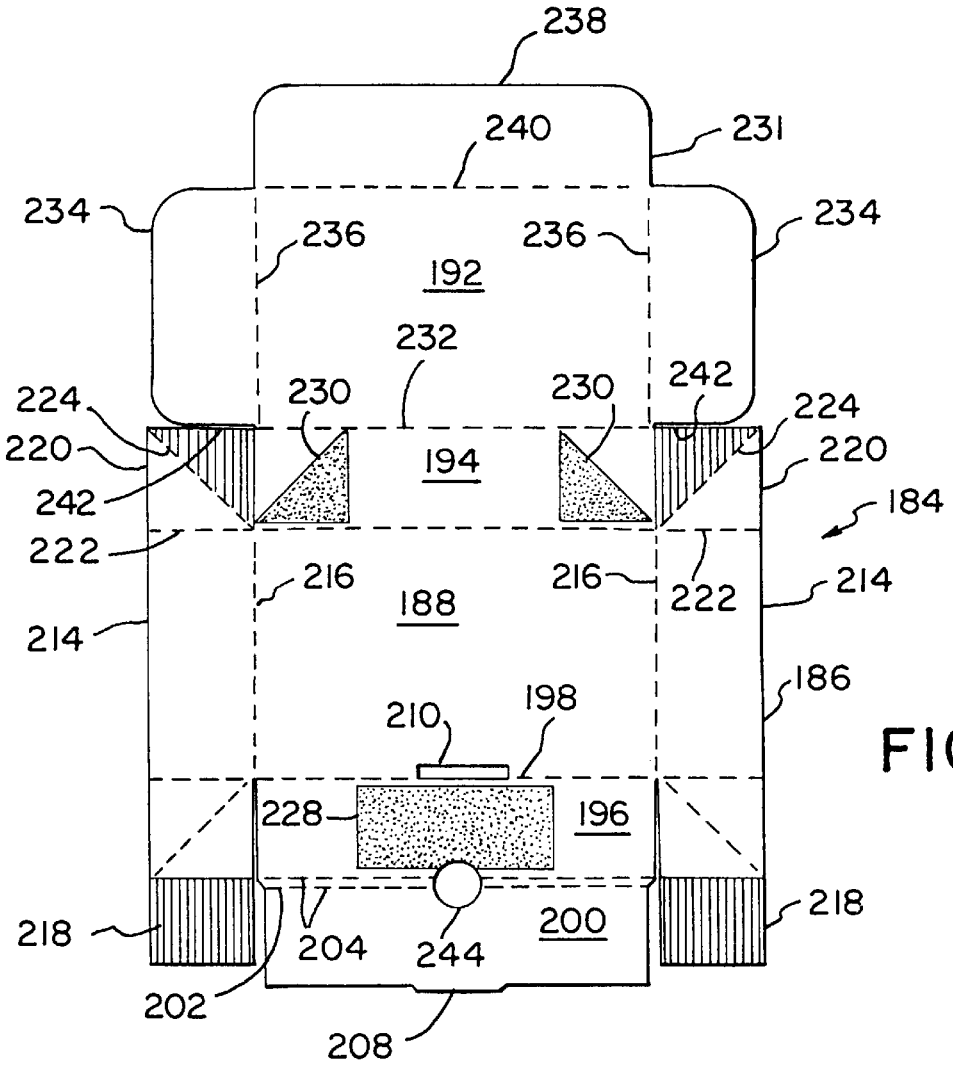
FIG. 9 is top plan view of a blank for an alternative embodiment lidded box of this invention.
Figure 10:
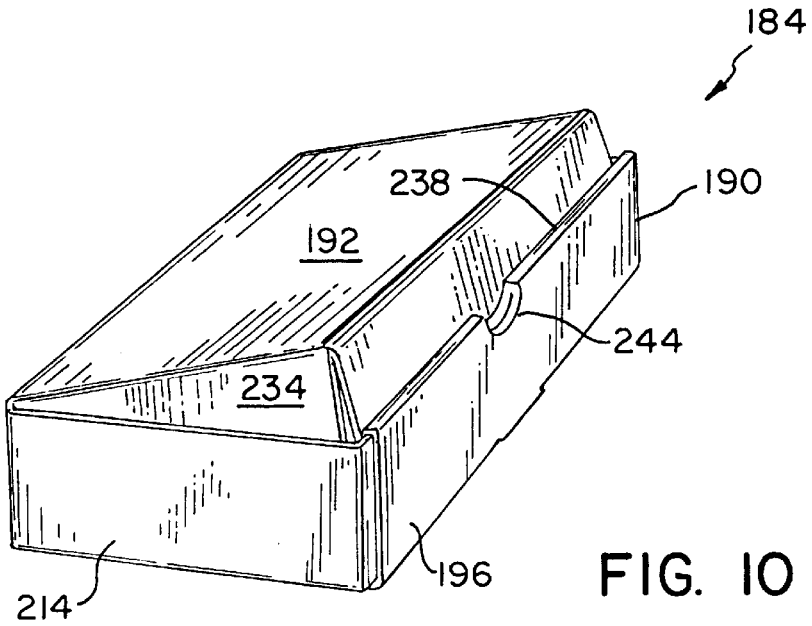
FIG. 10 is a perspective view of the glued up and assembled blank of FIG. 9 forming a lidded box.

As shown in FIGS. 9 and 10, another rapid assembly box 184 of this invention has a cover which is hinged to a rear wall and which has a front flap 238 which engages within a double thickness front wall 190. The box 184 is formed from a corrugated paperboard blank 186, shown in FIG. 9, which has a rectangular bottom panel 188. A double thickness front wall 190 extends from one side of the bottom panel 188, while a cover panel 192 extends from a rear panel 194 which is spaced parallel to the front wall 190. The front wall 190 is comprised of an outer front panel 196 which extends from the bottom panel 188 along a fold line 198, and an inner front panel 200 which extends from the outer front panel along a narrow spacer panel 202 which runs between two fold lines 204. The inner front panel 206 has a protruding lock tab 208 which is positioned to engage within a rectangular cut-out 210 formed in the bottom panel adjacent the outer front panel 212.

Two side panels 214 extend from the bottom panel 188 along parallel fold lines 216 which are spaced on either side of the front panels 196, 200 and the rear panel 194. Each side panel 214 has a front glue tab 218 and a rear glue tab 220. The glue tabs 218, 220 extend from a side panel 214 along a fold line 222 which is perpendicular to the fold lines 216 from which the side panels 214 extend from the bottom panel 188. The front glue tabs 218 are preferably sufficiently wide to extend to the center of the outer front panel 196 when glued thereto. The rear glue tabs 220 are only as wide as the depth of the rear panel 194, and hence will be approximately square. All the glue tabs have a glue tab fold line 224 which extends at an angle of about 45 degrees from the perpendicular fold line 222 defined at the corners of the assembled box.

Each glue tab 218, 220 is connected by an adhesive applied to a region of the glue tab outward of the glue tab fold line, as indicated by the shaded regions 228, 230 in FIG. 9. While the glue regions 228 are approximately rectangular where the front glue tabs 218 are attached to the outer front panel 196, the glue regions 230 where the rear glue tabs 220 are attached to the rear panel 194 are triangular.

A cover 231 extends from the rear panel 194. The cover 231 is comprised by the cover panel 192 which extends from the rear panel 194 along a fold line 232. The cover panel 192 has two opposed side flaps 234 which extend from fold lines 236, and a front flap 238 which extends from the cover panel 192 along a fold line 240 which is parallel to the fold line 232. In the assembled box, the cover front flap 238 engages within the box inside the inner front panel 200, and the cover side flaps 234 engage within the box inside the side panels 214. Each cover side flap 234 has a rear edge 242 which, in the closed box, engages a rear glue tab 220 against the rear panel 194, thereby holding the rear panel of the box perpendicular to the bottom panel 188.

To erect the box 184, the assembler grips the sides of the box, with thumbs on the interior of the side panels 214, and pivots the side panels outwardly into a position perpendicular to the bottom wall 188. The inner front panel 200 is then pivoted over the outer front panel 196 and the lock tab 208 engaged with the rectangular cut-out 210. After the contents have been placed within the box, the cover is then closed on the box to bring it into is final shape. To facilitate opening of the box, semicircular finger openings 244 may be cut in the front panels 196, 200.

Figure 11:
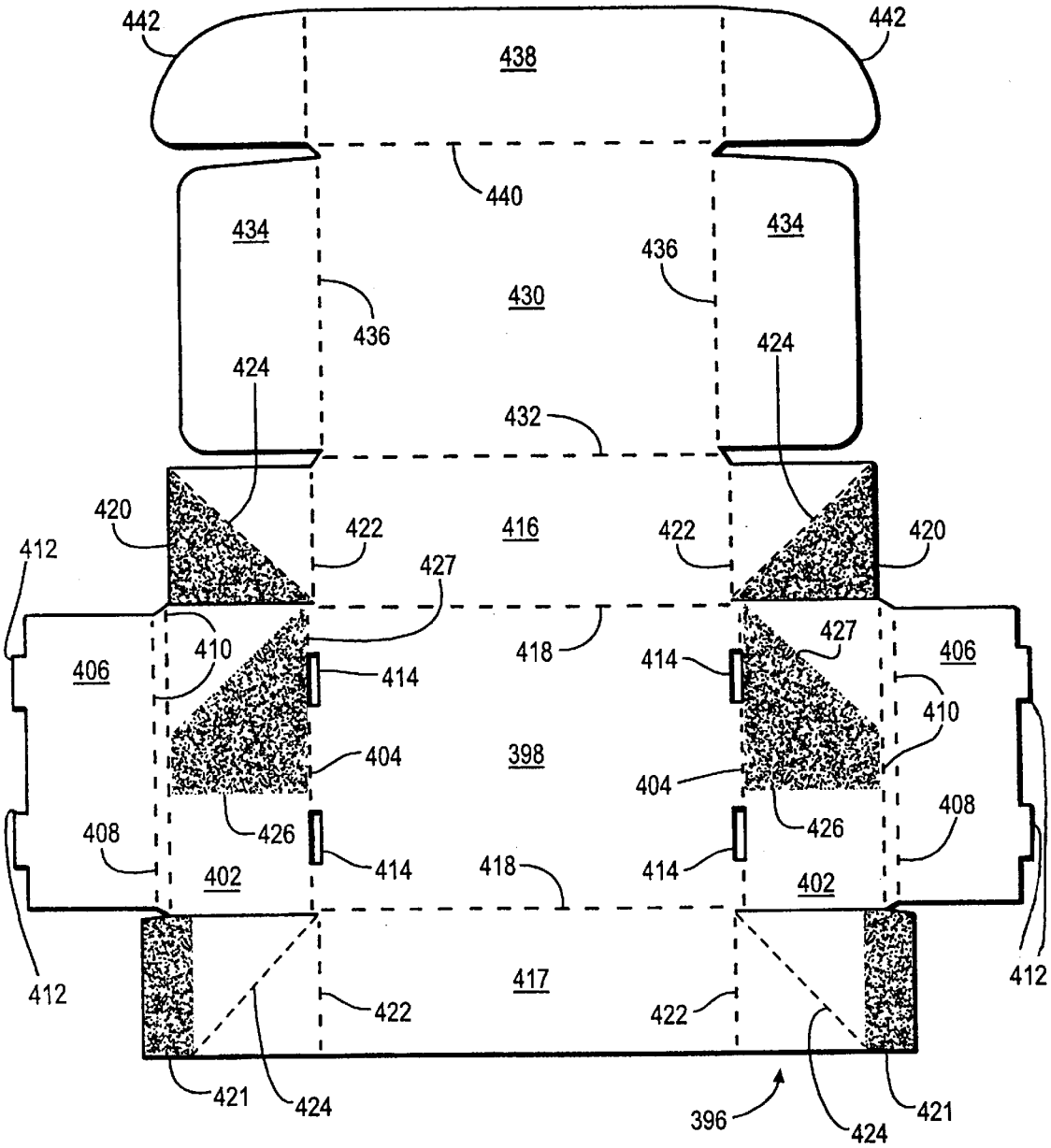
FIG. 11 is a top plan view of a blank for assembly into an alternative embodiment lidded box of this invention.
Figure 12:
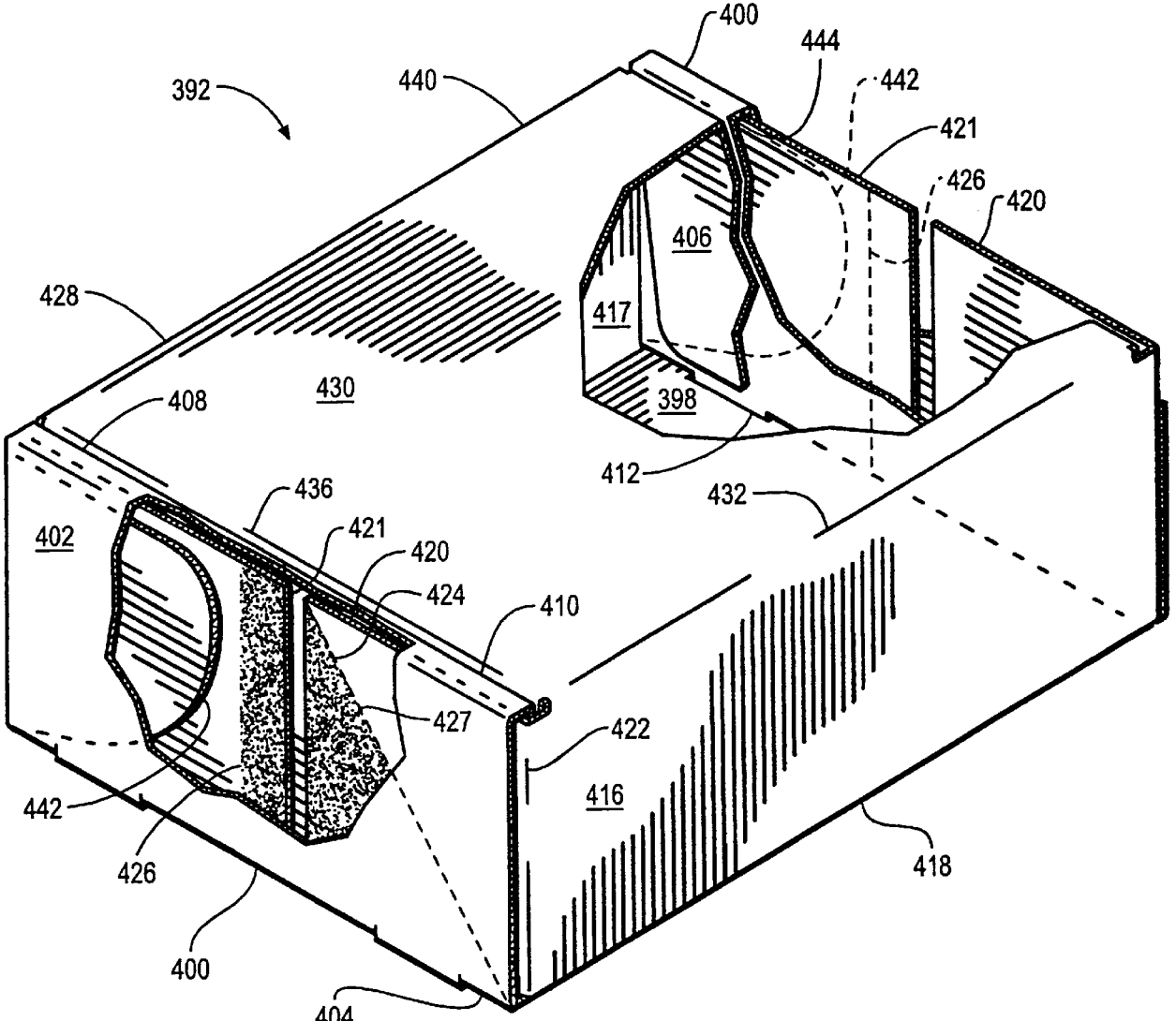
FIG. 12 is a rear isometric view, partially broken away in section, of the lidded box of FIG. 11.

An alternative embodiment rapid assembly box 392 of this invention which has a lid or cover 428, is shown in FIGS. 11 and 12. The box 392 is similar to the box 92, shown in FIGS. 4 and 5, but is proportionately deeper and narrower, and the construction is modified somewhat to permit the full height of the cover front flap tabs 442 to be received in pockets 444. The box 392 is formed from a corrugated paperboard blank 396 which has a rectangular bottom panel 398. Double thickness end walls 400 are formed on opposite sides of the bottom panel 398. Each end wall 400 is made up of an outer end panel 402 which extends from a fold line 404 adjacent the bottom panel, and an inner end panel 406 which is connected to the outer end panel by a narrow rectangular spacer panel 408. The inner end panel 406 and the outer end panel 402 extend from the spacer panel 408 along two parallel fold lines 410. Each inner end panel 406 has two protruding lock tabs 412 which are positioned to engage within rectangular cut-outs 414 formed in the bottom panel adjacent the outer end panel 402.

Two side panels 416, 417 extend from the bottom panel 398 along parallel fold lines 418 which are spaced on either side of the end panels. The cover 428 has a cover panel 430 which extends from the rear side panel 416 along a fold line 432. The cover panel 430 has two opposed side flaps 434 which extend from fold lines 436, and a front flap 438 which extends from the cover panel along a fold line 440 which is parallel to the fold line 432. The cover front flap 438 has two tabs 442 which extend outwardly and which have a rounded perimeter portion.

It will be noted that as the vertical depth of the box 398 increases, the material available to define the cover front flap tabs 442 also increases. Where the height of the box h measured vertically exceeds one quarter the length of the end panel and approaches one half the length of the end panels, there no longer is space available to receive the cover front flap tab 442 within a pocket defined between the end wall and an adhesively attached glue tab, if the glue tabs in front and in back are of equal size.

In the assembled box 392, the cover front flap tabs 442 are received within pockets 444 defined between the outer end panels 402 and the glue tabs 420 at regions where the glue tabs are not glued to the outer end panels.

The rear side panel 416 has two rear glue tabs 420, and the front side panel 417 has two front glue tabs 421. As shown in FIG. 11, each glue tab 420, 421 extends from a side panel 416. 417 along a fold line 422 which is perpendicular to the fold line 418. A glue tab fold line 424 extends from the fold line 422 at a 45 degree angle on each glue tab 420, 421.

To accommodate the enlarged cover front flap tabs 442, the front glue tabs 421 may extend a greater distance along the end panels than the rear glue tabs 420. The longer front glue tabs 421 are adhesively connected to the outer end panels 402 by a rectangular glue attachment region 426, indicated by shading in FIG. 11, which is positioned rearwardly of the pockets 444 which will be occupied by the front glue tabs 421. The rear glue tabs 420 are less than half the length of the outer end panels 402, and do not extend frontwardly beyond the glue tab fold line 124. The glue attachment region 427 on the rear glue tabs may thus be located only on the triangular region defined below the glue tab fold line 124.

The box 392 is erected in the same fashion as the box 92, and folds flat for shipment and storage in the same fashion.

It should be noted that the containers and assemblies shown above may be formed of varying dimensions, or with additional auxiliary panels and flaps in addition to those disclosed. Furthermore, the lock tabs and cut-out holes form a means for fastening inner panels over outer panels to clamp the glue tabs therebetween and prevent collapse of the perpendicular walls of the container. Other means for fastening inner panels over outer panels include the peel away liners over a pressure sensitive adhesive tape as shown in FIGS. 6–8. Other means would include lock tabs on one of the panels fitting into tabs with cutouts on the other of the panels.

It should be noted that where fold lines are referred to herein, any form of defining a distinct line of folding between two or more paperboard panels is meant to be included, including score lines, reverse score lines, and crease lines.

It is understood that the invention is not limited to the particular construction and arrangement of parts herein illustrated and described, but embraces such modified forms thereof as come within the scope of the following claims.

I claim:

1. A collapsible container comprising:

a rectangular bottom panel having two parallel first sides and two parallel second sides approximately perpendicular to the first sides;

two end panels, one extending from each of the first sides of the bottom panel along first fold lines;

a first outer side panel and a second outer side panel, one extending from each of the two second sides of the bottom panel along second fold lines;

two glue tabs extending from the first outer side panel in the direction of the second fold lines, such that the first outer side panel is positioned between two glue tabs, each glue tab extending from a side fold line which extends from one of the second fold lines, wherein a glue tab fold line is defined on each glue tab which extends from the side fold line, and an angle of approximately 45 degrees or less is defined between the glue tab fold line and the side fold line, and wherein portions of the glue tab between the glue tab fold line and the side fold line are not adhered to one of the end panels defining an unadhered segment, and portions of the glue tab between the unadhered segment and an end of the glue tab are adhered to one of the end panels, wherein the glue tab fold line extends from a lower edge of the glue tab to an upper edge of the glue tab, the glue tab fold line terminating at a first distance from the side fold line, the glue tab adhered portions extending entirely along those portions of the glue tab which are located at a distance greater than the first distance from the side fold line, to thereby define a pocket between the glue tab and the end panel; and second glue tabs which extend from the second outer side panel, the second glue tabs being each connected to an end panel, the second glue tabs having a second glue tab fold line;

a lid which extends from the second outer side panel, and which has portions which extend into the pocket;

additional panels which extend from each of the end panels along third fold lines which are parallel to the first fold lines, wherein each additional panel has portions which engage with the unadhered segment of the glue tabs in the assembled container to clasp the unadhered segment of the glue tabs between itself and one of the end panels to maintain the container in an erected configuration.

2. The collapsible container of claim 1 wherein each additional panel comprises an inner end panel which overlies the end panel from which it extends.

3. The collapsible container of claim 2 wherein at least one section of pressure sensitive adhesive is positioned on each inner end panel, and further comprising a release liner overlying each section of pressure sensitive adhesive in a collapsed configuration, the release liner being removable to expose the pressure sensitive adhesive section for adherence of the inner end panel to the end panel from which it extends.

4. The collapsible container of claim 1 wherein one of the additional panels comprises an inner end panel which overlies the end panel from which it extends, and the other of the additional panels comprises a lid which extends between the two end walls in the erected configuration, and the portions of the lid which engage with the unadhered segment of the glue tab comprise side flaps which extend downwardly from the lid.

5. The collapsible container of claim 1 wherein the angle defined between the glue tab fold line and the side fold line is approximately 45 degrees.

6. The collapsible container of claim 1 wherein the length of each glue tab is greater than one half the length of one of the end panels.

7. The collapsible container of claim 1 wherein the second glue tabs extend from the second outer side panel in the direction of the second fold lines, such that the second outer side panel is positioned between two second glue tabs, each second glue tab extending from a side fold line which extends from one of the second fold lines, wherein a second glue tab fold line is defined on each second glue tab which extends from the side fold line, and an angle of approximately 45 degrees or less is defined between the second glue tab fold line and the side fold line, and wherein portions of the second glue tab between the glue tab fold line and the side fold line are not adhered to one of the end panels defining an unadhered segment, and portions of the second glue tab between the unadhered segment and an end of the glue tab are adhered to one of the end panels, wherein the second glue tab fold line extends from a lower edge of the second glue tab to an upper edge of the second glue tab, the second glue tab fold line terminating at a second distance from the side fold line, the second glue tab adhered portions extending entirely along those portions of the glue tab which are located at a distance less than the second distance from the side fold line.

8. A collapsible container comprising:

a rectangular bottom panel having two parallel first sides and two parallel second sides approximately perpendicular to the first sides;

two end panels, one extending from each of the first sides of the bottom panel along first fold lines;

a front outer side panel;

a rear outer side panel, having two rear glue tabs with rear glue tab fold lines, portions of each of the rear glue tabs being adhered to one of the two end panels, and portions of each of the rear glue tabs being unadhered to the end panels, and wherein the front outer side panel and the rear outer side panel each extend from one of the two second sides of the bottom panel along second fold lines;

two front glue tabs extending from the front outer side panel in a first direction, such that the front outer side panel is positioned between two front glue tabs, each front glue tab extending from a side fold line which extends from one of the second fold lines, wherein a front glue tab fold line is defined on each front glue tab which extends from the side fold line, and an angle of about 45 degrees or less is defined between the front glue tab fold line and the side fold line, and wherein portions of the front glue tab between the front glue tab fold line and the side fold line are not adhered to one of the end panels defining an unadhered segment, and portions of the front glue tab between the unadhered segment and an end of the front glue tab are adhered to one of the end panels, wherein the front glue tab fold line extends from a lower edge of the front glue tab to an upper edge of the front glue tab, the front glue tab fold line terminating at a first distance from the side fold line in the first direction, wherein the front glue tab adhered portions include portions which are located at a distance greater than the first distance in the first direction from the side fold line;

inner end panels which extend from each of the end panels along third fold lines which are parallel to the first fold lines, wherein each inner end panel has portions which engage with the unadhered segment of the front glue tabs in the assembled container to clasp the unadhered segment of the glue tabs between itself and one of the end panels to maintain the container in an erected configuration;

a cover panel extending along a rear fold line from the rear outer side panel, a cover front flap which extends from the cover panel about a front fold line parallel to the rear fold line; and two cover tabs which extend from the cover front flap to be receivable between the unadhered portions of the front glue tabs and the end panels.

9. The collapsible container of claim 8 wherein the length of each rear glue tab is greater than one half the length of one of the end panels.

10. The collapsible container of claim 8 wherein the rear glue tabs extend from the rear outer side panel such that the rear outer side panel is positioned between the two rear glue tabs, each rear glue tab extending from a side fold line which extends from one of the second fold lines, wherein a rear glue tab fold line is defined on each rear glue tab which extends from the side fold line, and an angle of approximately 45 degrees or less is defined between the rear glue tab fold line and the side fold line, and wherein portions of the rear glue tab between the glue tab fold line and the side fold line are not adhered to one of the end panels defining the unadhered segment, and portions of the rear glue tab between the unadhered segment and an end of the rear glue tab are adhered to one of the end panels, wherein the rear glue tab fold line extends from a lower edge of the rear glue tab to an upper edge of the rear glue tab, the rear glue tab fold line terminating at a second distance from the side fold line, the rear glue tab adhered portions extending entirely along those portions of the glue tab which are located at a distance less than the second distance from the side fold line.

* * * * *